US011142885B2

(12) United States Patent
Krieger

(10) Patent No.: US 11,142,885 B2
(45) Date of Patent: Oct. 12, 2021

(54) MECHANICAL SELF-LEVELING LIFT ARM STRUCTURE FOR POWER MACHINE

(71) Applicant: Clark Equipment Company, West Fargo, ND (US)

(72) Inventor: Daniel J. Krieger, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 73 days.

(21) Appl. No.: 16/777,562

(22) Filed: Jan. 30, 2020

(65) Prior Publication Data

US 2020/0283991 A1 Sep. 10, 2020

Related U.S. Application Data

(60) Provisional application No. 62/798,806, filed on Jan. 30, 2019.

(51) Int. Cl.

| | |
|---|---|
| ***E02F 3/43*** | (2006.01) |
| ***E02F 3/34*** | (2006.01) |
| ***E02F 3/42*** | (2006.01) |

(52) U.S. Cl.

CPC ..... *E02F 3/433* (2013.01); *E02F 3/3405* (2013.01); *E02F 3/3414* (2013.01); *E02F 3/422* (2013.01)

(58) Field of Classification Search

None

See application file for complete search history.

(56) References Cited

U.S. PATENT DOCUMENTS

| | | | | | |
|---|---|---|---|---|---|
| 2,720,990 | A | * | 10/1955 | Beyerstedt | E02F 3/407 414/704 |
| 3,215,292 | A | * | 11/1965 | Halls | E02F 3/3405 414/707 |
| 3,237,795 | A | * | 3/1966 | Kromer | E02F 3/3622 414/713 |
| 3,703,968 | A | * | 11/1972 | Uhrich | B25J 9/1065 414/680 |
| 3,722,724 | A | * | 3/1973 | Blakely | E02F 3/283 414/713 |
| 3,767,075 | A | * | 10/1973 | Leverenz | E02F 3/3631 414/713 |
| 3,952,890 | A | * | 4/1976 | Armstrong | E02F 3/302 414/694 |

(Continued)

FOREIGN PATENT DOCUMENTS

| | | | |
|---|---|---|---|
| JP | 55126364 U | * | 9/1980 |
| JP | S55126364 U | | 9/1980 |
| JP | S55140556 U | | 10/1980 |

OTHER PUBLICATIONS

International Searching Authority, International Search Report and Written Opinion for application PCT/US2020/015925, dated May 6, 2020.

*Primary Examiner* — Gerald McClain

(57) ABSTRACT

A lift arm structure for a power machine with a frame can include a multi-bar linkage that is pivotally secured to the frame and a leveling link that is pivotally secured to the multi-bar linkage. The leveling link can be configured to transmit force from the leveling link to an implement as the multi-bar linkage is actuated to raise or lower the implement, including via a multi joint member that is pivotally secured to the leveling link, the multi-bar linkage, and an actuator that is configured to move the implement.

17 Claims, 14 Drawing Sheets

(56) References Cited

U.S. PATENT DOCUMENTS

| | | | | | |
|---|---|---|---|---|---|
| 5,192,179 | A * | 3/1993 | Kovacs | E02F 3/3408 | 414/710 |
| 5,533,856 | A * | 7/1996 | Friesen | E02F 3/3408 | 414/711 |
| 5,807,061 | A * | 9/1998 | Donoghue | E02F 3/3411 | 414/697 |
| 5,885,053 | A | 3/1999 | Deye | | |
| 6,474,933 | B1 * | 11/2002 | Hoechst | E02F 3/283 | 414/686 |
| 7,264,435 | B2 * | 9/2007 | Layko | E02F 3/342 | 414/686 |
| 7,354,237 | B2 * | 4/2008 | Frey | E02F 3/38 | 414/686 |
| 9,410,304 | B2 * | 8/2016 | Taylor | E02F 3/431 | |
| 10,676,893 | B1 * | 6/2020 | Williams | E02F 3/422 | |
| 2004/0228715 | A1 | 11/2004 | Roan | | |
| 2005/0036876 | A1 | 2/2005 | Walto | | |
| 2018/0305889 | A1 | 10/2018 | Schiwal | | |

* cited by examiner

MECHANICAL SELF-LEVELING LIFT ARM STRUCTURE FOR POWER MACHINE

RELATED APPLICATIONS

This application claims priority to U.S. Provisional Patent Application 62/798,806 titled "Mechanical Self-Leveling Lift Arm Structure for Power Machine" and filed Jan. 30, 2019, the entirety of which is incorporated herein by reference.

BACKGROUND

This disclosure is directed toward power machines. More particularly, this disclosure is directed to lift arm structures and related arrangements for a power machine. Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

One type of lift arm structure for power machines is a radius path lift arm structure. A radius path lift arm structure can include, for example, a lift arm that is pivotally attached to the frame of a power machine at a joint and a lift cylinder that is mounted to both the frame and the lift arm. Actuation of the lift cylinder can accordingly raise the lift arm such that the front end of the lift arm travels along an arcuate path with a radius centered on the joint at which the lift arm attaches to the frame.

In some cases, the path of the radius path lift arm is such that a bucket or other implement at a front end of the lift arm can tend to tip backwards as the lift arm is raised. This can be an issue, for example, due to material falling backwards off of the bucket or other implement. To address this issue, during operation of such a lift arm structure, an operator can sometimes control a tilt cylinder or other actuator to counteract the backwards tilt of the relevant implement and thereby impose a certain degree of leveling on the implement. Similarly, some systems can automatically divert a certain amount of hydraulic flow from a lift cylinder to a tilt cylinder, to help level an implement as a lift arm is raised and lowered. Or some conventional arrangements can include electronic self-leveling systems that can measure the orientation of the lift arm and the relevant implement (e.g., bucket) and can automatically adjust a tilt cylinder accordingly to help maintain a desired orientation of the bucket.

Another type of lift arm structure is known as a vertical path lift arm structure, which can utilize a multi-bar linkage to provide a less radial path for a lift arm than a comparable radius path lift arm structure. A vertical path lift arm structure can include, for example, a lift arm and a follower link that is pivotally coupled between and to the lift arm and a frame of the relevant power machine. Further, a driver link can be pivotally mounted between the frame and the lift arm to further constrain the path of the lift arm as it is raised and lowered. With the linkage thus arranged, the interaction of the lift arm, the follower link, and the driver link can cause the front end of the lift arm to raise vertically, or nearly vertically as the relevant lift cylinder is extended. Some vertical path lift arm structures reduce tilting of implement relative to radius path lift arm structures. But the relevant implement (e.g., buckets) may still exhibit non-negligible tilting over the full range of motion of the lift arms.

The discussion above is merely provided for general background information and is not intended to be used as an aid in determining the scope of the claimed subject matter.

SUMMARY

In some embodiments, a lift arm structure for a power machine can be configured to reduce the change in a tilt angle of an implement relative to a lift arm as the lift arm is raised over a particular course of travel.

In some embodiments, a lift arm structure can be provided for a power machine with a frame, for use with an implement, an implement carrier actuator that is configured to tilt the implement, and a lift actuator. The lift arm structure can include a four-bar linkage that is configured to raise and lower the implement, including a follower link pivotally secured to the frame, a lift arm pivotally secured to the follower link and to the lift actuator, and a driver link. The driver link can be pivotally secured to the lift arm and pivotally secured to the frame separately from the follower link. A bell crank can be pivotally secured to the implement carrier actuator and to the lift arm. A leveling link can be pivotally secured to the follower link and to the bell crank, to transmit force from the follower link to the implement carrier actuator via the bell crank as the lift actuator moves the four-bar linkage.

In some embodiments, a lift arm structure can be provided for a power machine with a frame, for use with an implement and an implement carrier actuator that is configured to tilt the implement. The lift arm structure can include a four-bar linkage that is pivotally secured to the frame, and a leveling link that is pivotally secured to the four-bar linkage. A multi joint member can be pivotally secured to the leveling link, the four-bar linkage, and the implement carrier actuator, to transmit force from the leveling link to the implement carrier actuator as the four-bar linkage is actuated to raise or lower the implement.

In some embodiments, a lift arm structure can be provided for a power machine with a frame, for use with an implement and an implement carrier actuator that is configured to tilt the implement. The lift arm structure can include a multi-bar linkage that is pivotally secured to the frame. The multi-bar linkage can include a lift arm and a follower link, with a leveling joint on the follower link that is configured to move away from the implement before moving toward the implement as the multi-bar linkage is actuated to raise the lift arm. A leveling link can be pivotally secured to the follower link at the leveling joint and further pivotally secured to the implement carrier actuator and to the lift arm, to transmit force from the follower link to move the implement carrier actuator relative to the lift arm as the multi-bar linkage is actuated to raise or lower the implement.

In some embodiments, a mini-loader can include a frame. An operator station can be positioned toward the rear of the frame and configured to be used by an operator who is behind or on the rear of the frame. A lift actuator can be movable between a retracted position and an extended position. A lift arm structure can be movable by the lift actuator relative to the frame and can include a multi-bar linkage configured to raise and lower an implement supported by the lift arm structure as the lift actuator moves between the retracted and extended positions. The multi-bar linkage can include a follower link, a lift arm, a drive link, a multi-joint member and a leveling link. The follower link can be pivotally secured to the frame. The lift arm can be pivotally secured to the follower link and to the lift actuator. The driver link can be pivotally secured to the lift arm and to the frame. The multi joint member can be pivotally secured to the implement and to the lift arm. The leveling link can be pivotally secured to the follower link and to the multi joint member to transmit force from the follower link to the implement via the multi joint member as the lift actuator moves between the retracted position and the extended position.

In some embodiments, a lift arm structure for a power machine with a frame can be configured for use with an implement and an implement actuator that is configured to tilt the implement. The lift arm structure can include a vertical path lift arm structure that includes first and second links that are separately pivotally secured to the frame and to a lift arm. A leveling link can be pivotally secured to the first link. A multi joint member can be pivotally secured to the leveling link, the lift arm, and the implement actuator, to mechanically transmit tilting force from the leveling link to the implement, via the implement actuator, as the lift arm structure is actuated to raise or lower the implement.

In some embodiments, a lift arm structure for a power machine with a frame can be configured for use with an implement carrier. The lift arm structure can include a multi-bar linkage and a leveling link. The multi-bar linkage can be pivotally secured to the frame and can include a lift arm and a follower link with a leveling joint. The follower link can be pivotally secured to the lift arm and to the frame. The leveling link can be pivotally secured to the follower link at the leveling joint, and also pivotally secured to the implement carrier and to the lift arm, to mechanically transmit force from the follower link to the implement carrier and thereby urge the implement carrier to pivot relative to the lift arm as the multi-bar linkage is actuated to raise or lower the implement carrier.

This Summary and the Abstract are provided to introduce a selection of concepts in a simplified form that are further described below in the Detailed Description. This Summary is not intended to identify key features or essential features of the claimed subject matter.

DRAWINGS

DETAILED DESCRIPTION

Figure 1:
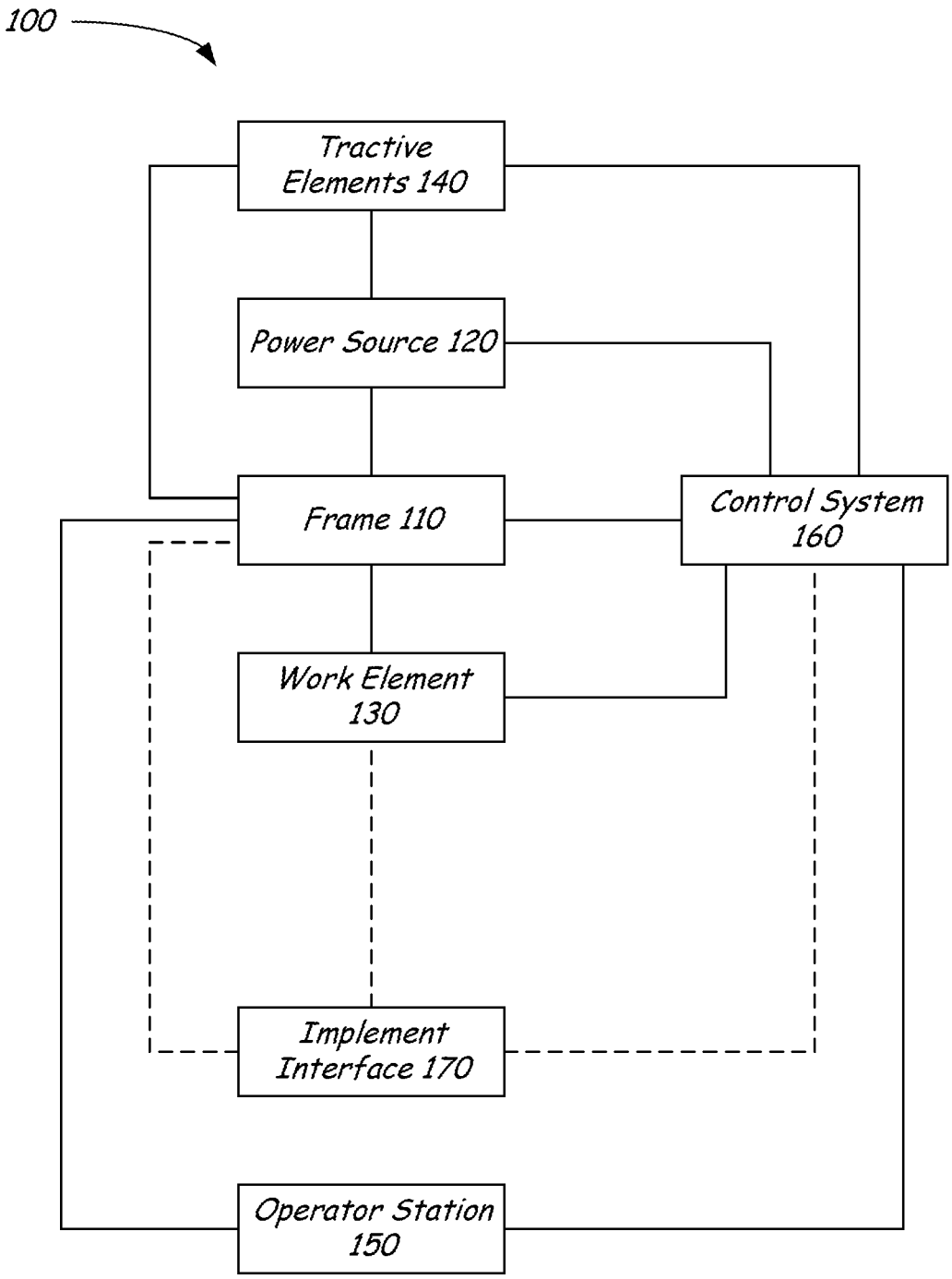
FIG. 1 is a block diagram illustrating functional systems of a representative power machine on which embodiments of the present disclosure can be advantageously practiced.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings unless identified as such.

Some of the discussion below describes a lift arm structure for a power machine that is configured for use with an implement and an implement carrier actuator that can tilt the implement. In some embodiments, the lift arm structure can be configured to help automatically reduce a degree of tilt of the implement during a lifting operation.

The context and particulars of this discussion are presented as examples only. For example, embodiments of the disclosed invention can be configured in various ways, including with different materials and arrangements of elements. Similarly, embodiments of the invention can be used with various types of power equipment, including loaders, excavators, utility vehicles, tractors, and trenchers, or other types of power equipment other than those expressly illustrated or described herein.

In some embodiments, a lift arm structure can be provided that includes a multi-bar linkage with a lift arm, an implement secured toward a front end of the lift arm, and a follower link that is secured to both the frame and the lift arm opposite the implement. A leveling link can be secured to the follower link, such as at a joint somewhat above the lift arm. Further, a multi-joint member, such as a bell crank, can secure the leveling link and a tilt actuator for the implement to the lift arm, generally opposite the follower link. With this arrangement, for example, as the multi-bar linkage is actuated to raise the lift arm, the leveling link can mechanically transmit force from the follower arm to the tilt actuator via the multi joint member, to help reduce a degree of backwards tilting of the implement.

As used herein, unless otherwise specified or limited, a "multi joint member" refers to a member of a linkage arrangement that includes a plurality of pivotable joints for connection to other members (e.g., links) of the linkage arrangement. In some arrangements, a multi joint member can include separate pivotable joints for independent pivotable attachment to respective other members of a linkage arrangements. In some arrangements, a multi-joint member can include at least three pivotable joints (e.g., pin seats), including at least three pivotable joints configured for independent pivotable attachment to three distinct other members of the linkage arrangement. For example, a bell crank or other similar body can be configured to be pivotally coupled with three (or more) different links of a linkage at three (or more) distinct pivotable joints on the bell crank or other body.

In some embodiments, a lift arm structure can be configured as a somewhat conventional four-bar linkage for a vertical path lift arm structure. In this regard, for example, a follower link of the four-bar linkage can be configured to pivot backwards at the start of a lifting operation, then forwards as the lifting operation progresses. Accordingly, a leveling link that extends between the follower link and a tilt actuator for an implement attached to the lift arm structure, including via a connection at a multi joint member such as a bell crank, can automatically mechanically reduce an amount of backward tilt of the implement during a lifting operation. In some embodiments, the leveling link can be moved forward to reduce backward tilting of an implement by forward rotation of a follower link of a vertical path lift arm structure.

Figure 2:
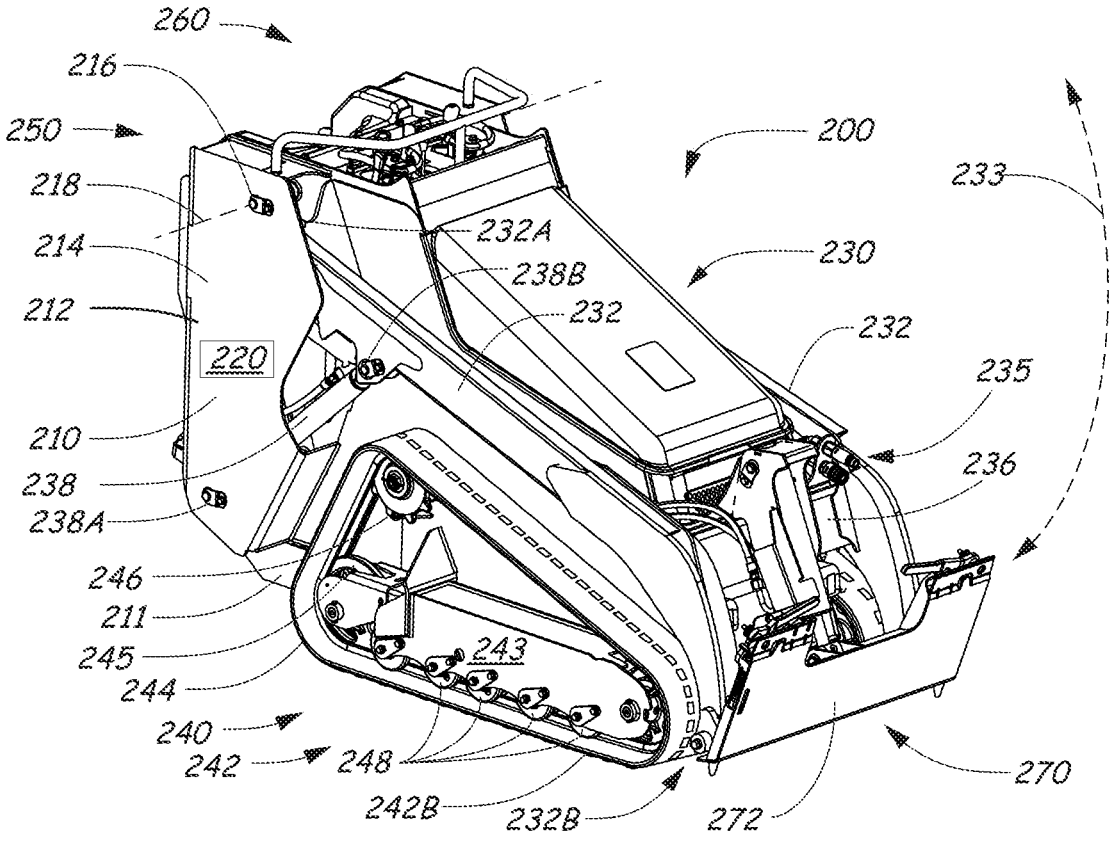
FIGS. 2-3 illustrate perspective views of a representative power machine in the form of a skid-steer loader of the type on which the disclosed embodiments can be practiced.
Figure 3:
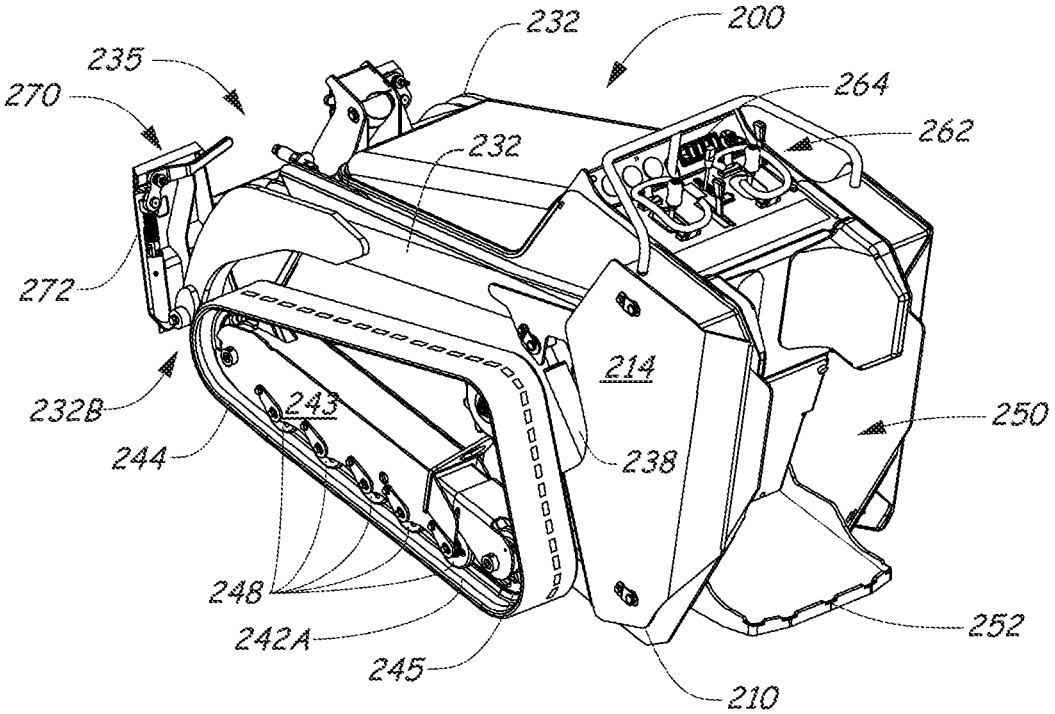

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which represents any of a number of different types of power machines upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm, can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as an implement interface 170 shown in FIG. 1. At its most basic, the implement interface 170 is a connection mechanism between the frame 110 or a work element 130 and an implement, which can be as simple as a connection point for attaching an implement directly to the frame 110 or the work element 130 or more complex, as discussed below.

On some power machines, the implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to the work element 130, such as a lift arm, or the frame 110. The implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

The frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

The frame 110 supports the power source 120, which is configured to provide power to one or more work elements 130 including the one or more tractive elements 140, as well as, in some instances, providing power for use by an attached implement via the implement interface 170. Power from the power source 120 can be provided directly to any of the work elements 130, the tractive elements 140, and the implement interfaces 170. Alternatively, power from the power source 120 can be provided to the control system 160, which in turn selectively provides power to the elements that are capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, the tractive elements 140 are a special case of work element in that their work function is generally to move the power machine 100 over a support surface. The tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

The power machine 100 includes the operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as the power machine 100 and others, whether they have operator compartments or operator positions or not, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both the power machine and any implement to which is it coupled) that can control at least some of the operator-controlled functions on the power machine.

FIGS. 2-3 illustrate a loader 200, which is one particular example of a power machine of the type illustrated in FIG. 1 where the embodiments discussed below can be advantageously employed. The loader 200 is a tracked loader and more particularly, a mini-loader. A mini-loader for the purposes of this discussion is a small loader relative to other compact loaders such as traditional skid-steer loaders and compact track loaders without an operator cab that can be operated from an operator station at the back of the loader. Some mini-loaders have a platform on which an operator can ride on. Other mini-loaders can be operated by an operator who walks behind the loader. Still other mini-loaders have a platform that is moveable or removable to allow an operator to alternatively ride on the platform or walk behind the loader. The loader 200 is a tracked loader, in some embodiments mini-loaders can be wheeled loaders as well.

The loader 200 is one particular example of the power machine 100 illustrated broadly in FIG. 1 and discussed above. To that end, features of the loader 200 described below include reference numbers that are generally similar to those used in FIG. 1. For example, the loader 200 is described below as having a frame 210, just as the power machine 100 has the frame 110. The track loader 200 is described herein to provide a reference for understanding one environment on which the embodiments described below related to operator controls may be practiced. The loader 200 should not be considered limiting especially as to features that the loader 200 may have described herein that are not essential to the disclosed embodiments. Such features may or may not be included in power machines other than the loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

As mentioned above, the loader 200 includes the frame 210. The frame 210 supports a power system 220, the power system 220 being configured to generate or otherwise provide power for operating various functions on the power machine. The frame 210 also supports a work element in the form of a lift arm structure 230 that is selectively powered by the power system 220 in response to signals from an operator control system 260 and can perform various work tasks. As the loader 200 is a work vehicle, the frame 210 also supports a traction system 240, which is also selectively powered by the power system 220 in response to signals from the operator control system 260. The traction system 240 is configured to propel the power machine over a support surface. The lift arm structure 230 in turn supports an implement carrier 272, which is configured to receive and secure various implements to the loader 200 for performing various work tasks. The loader 200 can be operated from an operator station 250 from which an operator can manipulate various control devices to cause the power machine to perform various functions, discussed in more detail below.

Various power machines that can include and/or interact with the structures and/or functions of embodiments discussed below can have various frame components that support various work elements. The elements of frame 210 discussed herein are provided for illustrative purposes and are not necessarily the only type of frame that a power machine on which the embodiments discussed below can be practiced can be employed, unless otherwise specifically indicated. The frame 210 of the loader 200 includes an undercarriage or lower portion 211 of the frame and a mainframe or upper portion 212 of the frame that is supported by the undercarriage. The mainframe 212 of the loader 200 is attached to the undercarriage 211 such as with fasteners or by welding the undercarriage to the mainframe. The mainframe 212 includes a pair of upright portions 214 located on either side and toward the rear of the mainframe that support the lift arm structure 230 and to which the lift arm structure 230 is pivotally attached. The lift arm structure 230 is illustratively pinned to each of the upright portions 214. The combination of mounting features on the upright portions 214 and the lift arm structure 230 and mounting hardware (including pins used to pin the lift arm structure to the mainframe 212) are collectively referred to as joints 216 (one is located on each of the upright portions 214) for the purposes of this discussion. The joints 216 are aligned along an axis 218 so that the lift arm structure is capable of pivoting, as discussed below, with respect to the frame 210 about axis 218. Other power machines may not include upright portions on either side of the frame or may not have a lift arm structure that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. The frame 210 also supports a pair of tractive elements 242 on either side of the loader 200, which on the loader 200 are track assemblies.

The lift arm structure 230 shown in FIGS. 2-3 is one example of a lift arm structure that can be attached to a power machine such as the loader 200 or other power machines on which embodiments of the present discussion can be practiced. The lift arm structure 230 has a set of lift arms 232 that are disposed on opposing sides of the frame 210. (It should be noted, however, that a lift arm structure may incorporate only a single lift arm or exhibit other similar configurations.) A first end 232A of each of the lift arms 232 is pivotally coupled to the power machine at joints 216 and a second end 232B of each of the lift arms is positioned forward of the frame 210 when in a lowered position as shown in FIG. 2. The lift arm structure 230 is moveable (i.e., the lift arm structure can be raised and lowered) under control of the loader 200 with respect to the frame 210. That movement (i.e., the raising and lowering of the lift arm structure 230) is described by a radial travel path, shown generally by arrow 233. For the purposes of this discussion, the travel path 233 of the lift arm structure 230 is defined by the path of movement of the second end 232B of the lift arm structure.

The lift arms 232 are each coupled to a cross member 236 that provides increased structural stability to the lift arm structure 230. A pair of actuators 238, which on loader 200 are hydraulic cylinders configured to selectively receive pressurized fluid from power system 220, are pivotally coupled to both the frame 210 and the lift arms 232 at pivotable joints 238A and 238B, respectively, on either side of the loader 200. The actuators 238 are sometimes referred to individually and collectively as lift cylinders. Actuation (i.e., extension and retraction) of the actuators 238 causes the lift arm structure 230 to pivot about joints 216 and thereby be raised and lowered along a fixed path illustrated by arrow 233. The lift arm structure 230 shown in FIGS. 2-3 is representative of one type of lift arm structure that may be coupled to the power machine 200. Other lift arm structures, with different geometries, components, and arrangements can be pivotally coupled to the loader 200 or other power machines upon which the embodiments discussed herein can be practiced without departing from the scope of the present discussion. For example, other machines can have lift arm structures with lift arms that each have two portions (as opposed to the single piece lift arms 232) that are pivotally coupled to each other along with a control arm to create a four-bar linkage and a substantially vertical travel path or at least more vertical than the radial path of lift arm structure 230. Other lift arm structures can have an extendable or telescoping lift arm. Still other lift arm structures can have several (i.e. more than two) portions segments or portions. Some lift arms, most notably lift arms on excavators but also possible on loaders, may have portions that are controllable to pivot with respect to another segment instead of moving in concert (i.e., along a pre-determined path) as is the case in the lift arm structure 230 shown in FIGS. 2-3. Some power machines have lift arm structures with a single lift arm, such as is known in excavators or even some loaders and other power machines. Other power machines can have a plurality of lift arm structures, each being independent of the other(s).

An example of an implement interface 270 is provided at the second end 232B of the lift arms 232, as shown in FIG. 2. The implement interface 270 includes the implement carrier 272 that is configured to accept and secure a variety of different implements to the lift arm structure 230. Such implements have a machine interface that is configured to be engaged with the implement carrier 272. The implement carrier 272 is pivotally mounted to the second end 232B of each of the arms 232. An implement carrier actuator 237 is operably coupled to the lift arm structure 230 and the implement carrier 272 and is operable to rotate the implement carrier with respect to the lift arm structure 230. Other examples of power machines can have a plurality of implement carrier actuators. Still other examples of power machines of the type that can advantageously employ the disclosed embodiments discussed herein may not have an implement carrier such as implement carrier 272, but instead may allow only for implements to be directly attached to its lift arm structure such as by pinning.

The implement interface 270 also includes an implement power source 235 available for connection to an implement on the lift arm structure 230. The implement power source 235 includes pressurized hydraulic fluid ports to which an implement can be coupled. The pressurized hydraulic fluid port selectively provides pressurized hydraulic fluid for powering one or more functions or actuators on an implement. The implement power source can, but need not, include an electrical power source for powering electrical actuators and/or an electronic controller on an implement. The electrical power source can also include electrical conduits that are in communication with a data bus on the loader 200 to allow communication between a controller on an implement and electronic devices on the loader 200. It should be noted that the specific implement power source on loader 200 does not include an electrical power source.

The lower frame portion 211 supports and has attached to it a pair of tractive elements, identified in FIGS. 2-3 as left track assembly 242A and right track assembly 242B (collectively tractive elements 242). Each of the tractive elements 242 has a track frame 243 that is coupled to the frame 210. The track frame 243 supports and is surrounded by an endless track 244, which rotates under power to propel the loader 200 over a support surface. Various elements are coupled to or otherwise supported by the track frame 243 for engaging and supporting the endless track 244 and cause it to rotate about the track frame. For example, a sprocket 246 is supported by the track frame 243 and engages the endless track 244 to cause the endless track to rotate about the track frame. An idler 245 is held against the track 244 by a tensioner (not shown) to maintain proper tension on the track 244. The track frame 243 also supports a plurality of rollers 248, which engage the track and, through the track, the support surface to support and distribute the weight of the loader 200.

The operator station 250 is positioned toward the rear of the frame 210. A platform 252 is provided for the operator to stand. While standing on the platform 252, and operator has access to a plurality of operator control inputs 262 that, when manipulated by the operator, can provide control signals to control work functions of the power machine 200, including, for example, the traction system 240 and the lift arm 230. Operator control inputs 262 can include joysticks with adjacent reference bars of the type discussed below. In the embodiment shown in FIGS. 2-3, the operator station 250 is open to the back of the power machine 200. Similar other power machines, including other mini-loaders, can include operator stations toward the rear of the respective frames, without necessarily being open to the back of the power machines. Additionally, some power machines may include operator stations toward the rear of a frame, including operator stations that are open to the back of the frame, but without a support (e.g., standing) platform for an operator. For example, some operator stations include controls that can be operated by an operator walking behind the power machine.

Display devices 264 are provided in the operator station to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be designed to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

Figure 4:
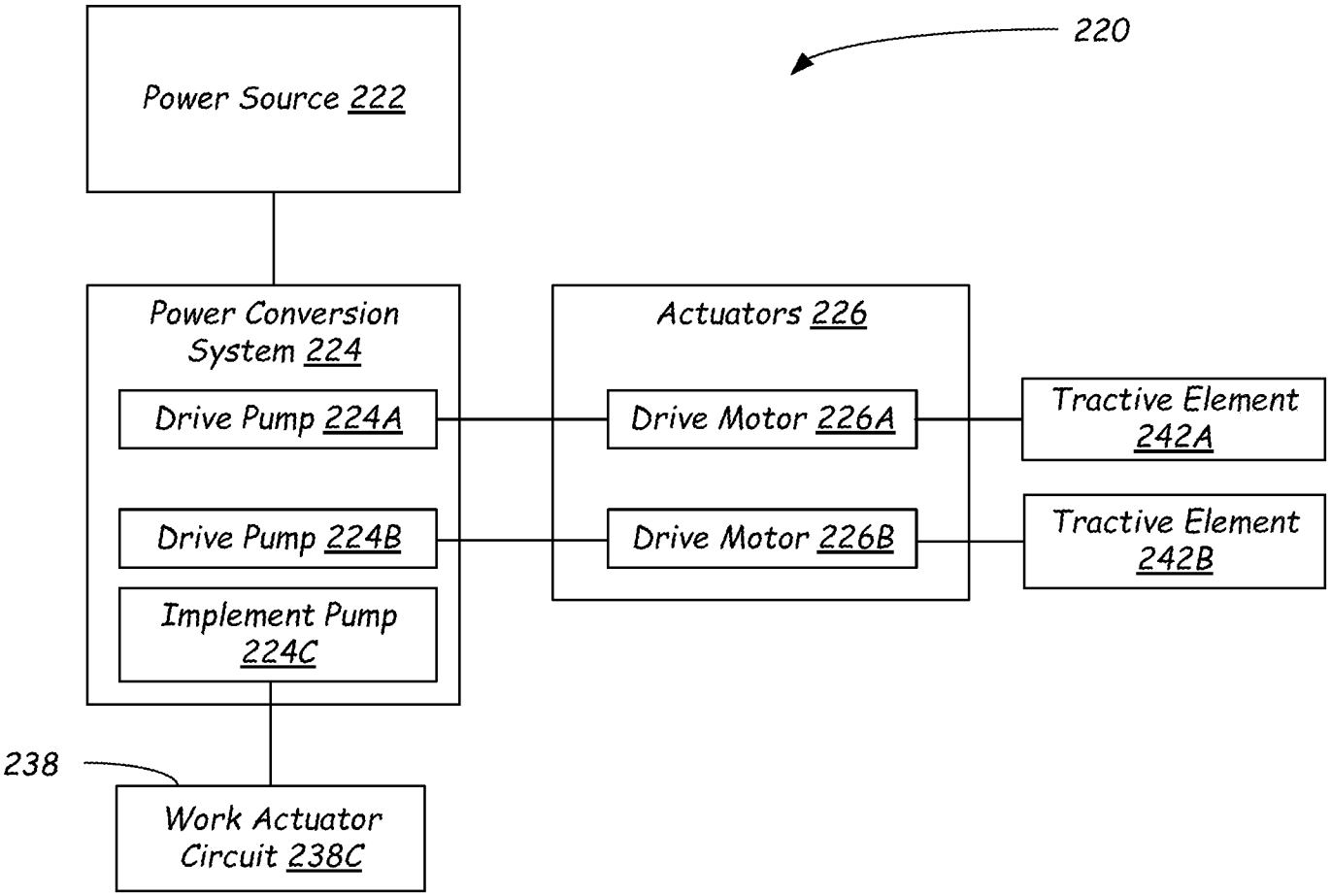
FIG. 4 is a block diagram illustrating components of a power system of a loader such as the loader illustrated in FIGS. 2-3.

Frame 210 supports and generally encloses the power system 220 so that the various components of the power system 220 are not visible in FIGS. 2-3. FIG. 4 includes, among other things, a diagram of various components of the power system 220. Power system 220 includes one or more power sources 222 that are configured to generate and/or store power for use on various machine functions. On the power machine 200, the power system 220 includes an internal combustion engine. Other power machines can include electric generators, rechargeable batteries, various other power sources or any combination of power sources that can provide power for given power machine components. The power system 220 also includes a power conversion system 224, which is operably coupled to the power source 222. Power conversion system 224 is, in turn, coupled to one or more actuators 226, which can perform a function on the power machine. Power conversion systems in various power machines can include various components, including mechanical transmissions, hydraulic systems, and the like. The power conversion system 224 of power machine 200 includes a pair of hydrostatic drive pumps 224A and 224B, which are selectively controllable to provide a power signal to drive motors 226A and 226B. The drive motors 226A and 226B in turn are each operably to tractive elements 242A-B, respectively. The drive pumps 224A and 224B can be mechanically, hydraulically, and/or electrically coupled to operator input devices to receive actuation signals for controlling the drive pumps.

The power conversion system 224 of power machine 200 also includes a hydraulic implement pump 224C, which is also operably coupled to the power source 222. The hydraulic implement pump 224C is operably coupled to work actuator circuit 238C. Work actuator circuit 238 includes lift cylinders 238 and tilt cylinders 235 as well as control logic to control actuation thereof. The control logic selectively allows, in response to operator inputs, for actuation of the lift cylinders and/or tilt cylinders. In some machines, the work actuator circuit also includes control logic to selectively provide a pressurized hydraulic fluid to an attached implement. The control logic of power machine 200 includes an open center, 3-spool valve in a series arrangement. The spools are arranged to give priority to the lift cylinders, then the tilt cylinders, and then pressurized fluid to an attached implement.

Figure 5:
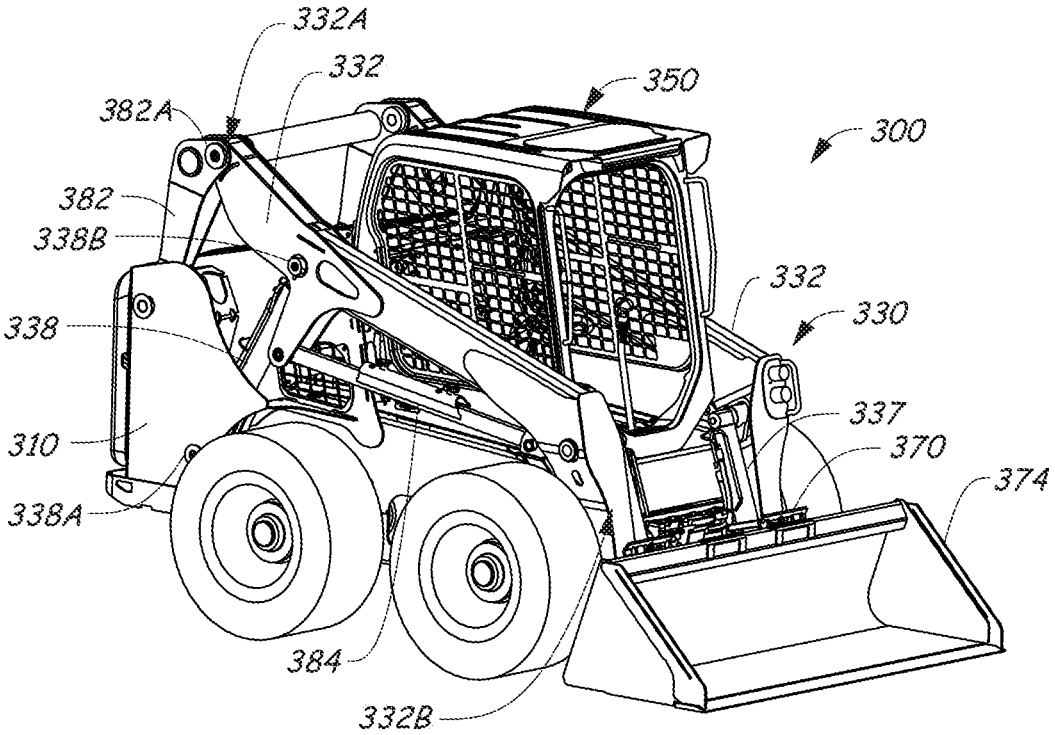
FIG. 5 illustrates a perspective view of a representative power machine in the form of a skid-steer loader of the type on which the disclosed embodiments can be practiced.

FIG. 5 illustrates a loader 300, which is another particular example of a power machine of the type illustrated in FIG. 1 where the embodiments discussed herein can be advantageously employed. Loader 300 is similar in some ways to the loader 200 described above, and like numbers represent similar parts. For example, similarly to the loader 200, the loader 300 has a frame 310, and at least one lift arm (here, as above, provided as a set of lift arms 332) that is pivotally coupled to an implement interface 370. Moreover, the loader 300 also has a set of actuators 338 that are pivotally coupled to both the frame 310 and the lift arms 332 at pivotable joints 338A and 338B, respectively, on either side of the loader 200, 300. The actuators 338 are sometimes referred to individually and collectively as lift cylinders and are shown here as hydraulic cylinders configured to selectively receive pressurized fluid from a power system 320; however, other types of actuators are contemplated. The loader 300 also has an operator station 350 and a set of implement carrier actuators 337 that are pivotally coupled to the lift arms 332 and to the implement interface 370 to allow active tilting of the implement interface 370 (and implements secured thereto).

One way in which loader 300 differs from loader 200 is that the lift arm structure 330 incorporates a vertical path lift arm structure rather than a radial path lift arm structure. As such, for example, the loader 300 includes a set of follower links 382 and a set of driver links 384. Each of the follower links 382 is pivotally coupled to the frame 310 and is separately pivotally coupled to a first end 332A of a respective one of the lift arms 332 at a lift arm pivotable joint 382A. Each of the driver links 384 is pivotally coupled to one of the pair of lift arms 332 and the frame 310. As noted above, although the illustrated configuration of the loader 300 includes sets of two substantially identical instances of the follower links 382, the lift arms 332, the driver links 382, and so on, other configurations can include a different number (e.g., one) or configuration of each of these elements or others.

Figure 6:
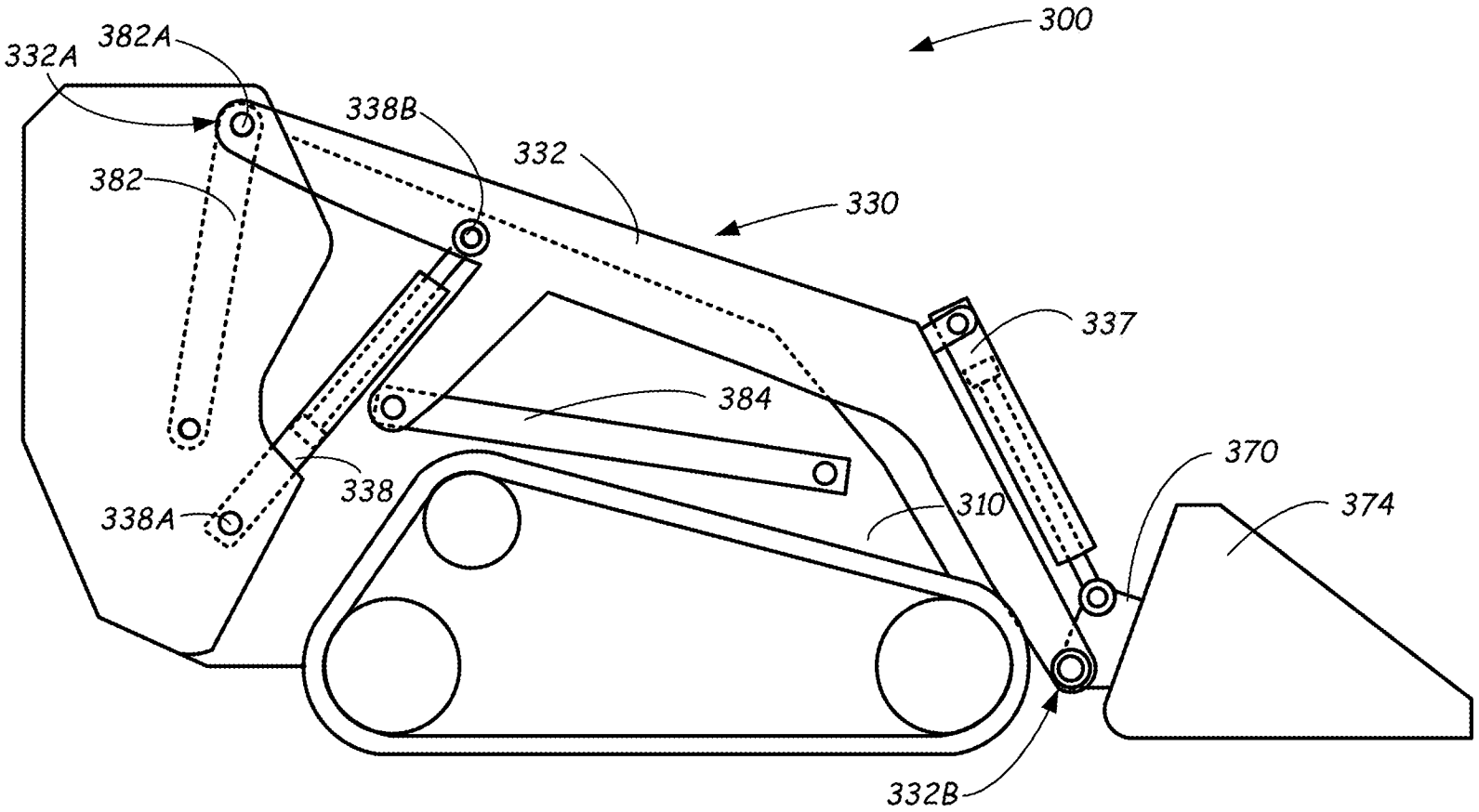
FIGS. 6-8 are schematic side elevation views of the power machine shown in FIGS. 2-3 during a lifting operation.
Figure 7:
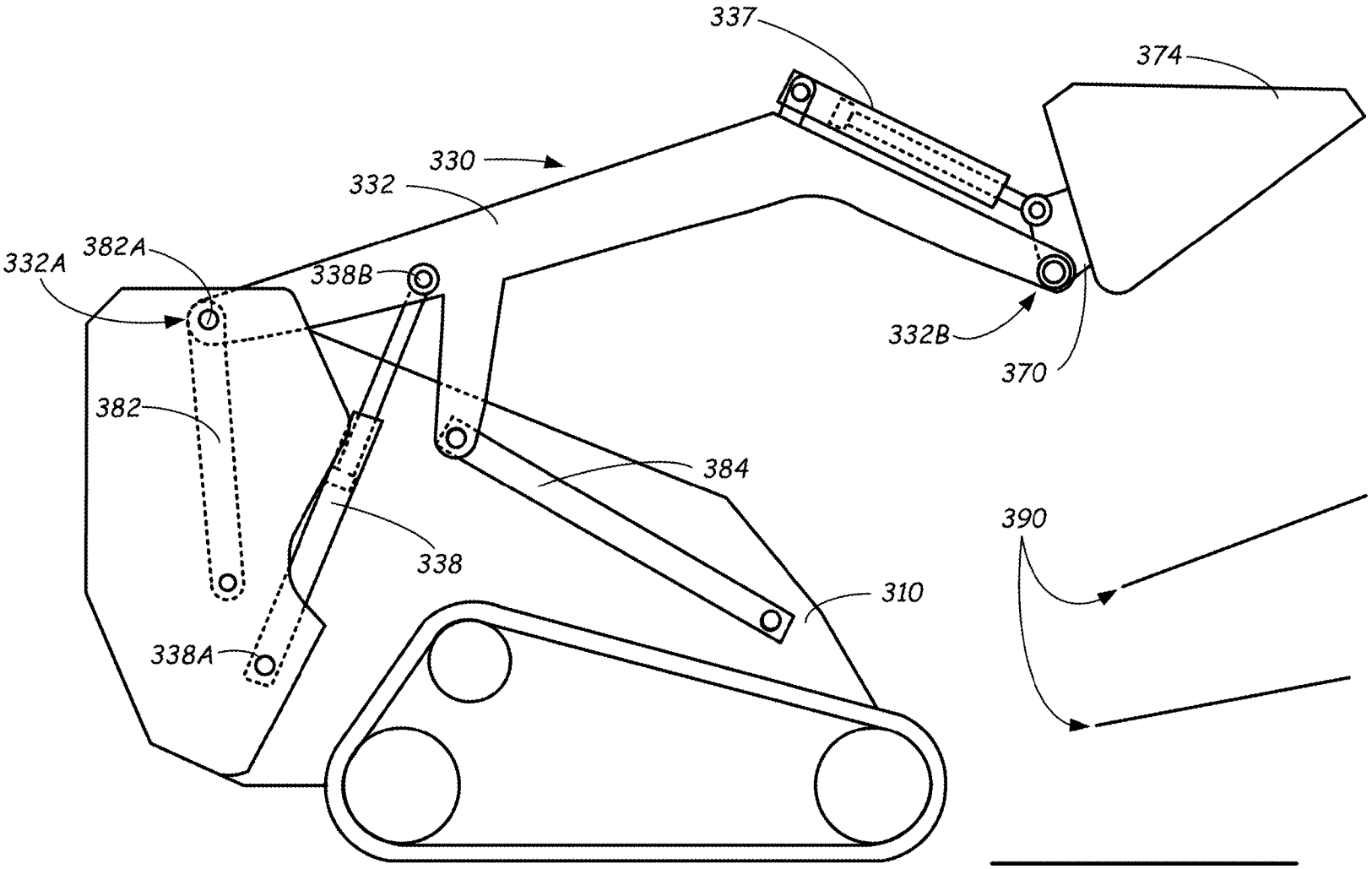
Figure 8:
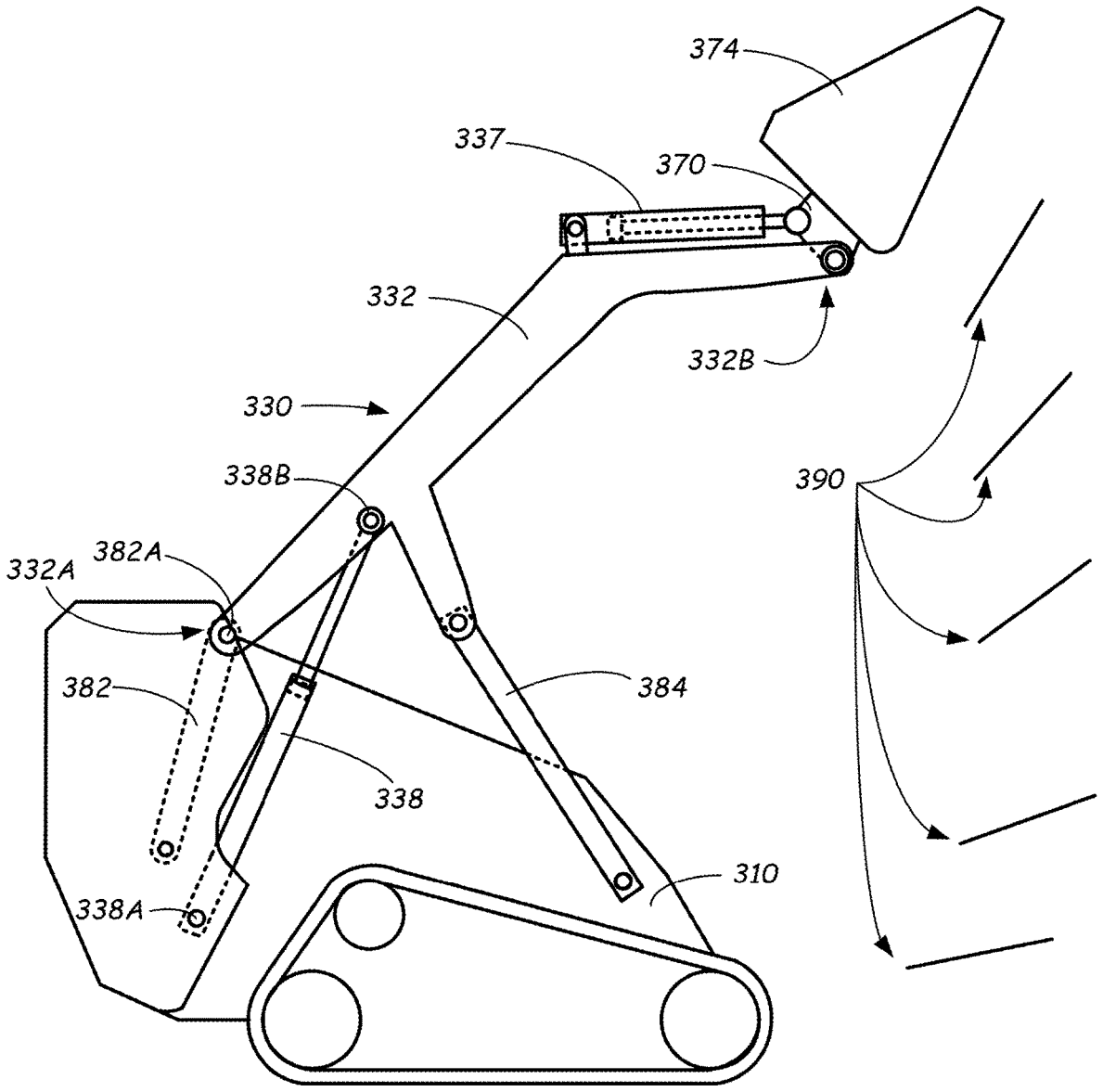

With the illustrated arrangement, the frame 310, the follower links 382, the driver links 384, and the lift arms 332 form a four-bar linkage on each side of the loader 300. Accordingly, as the lift arms 332 are raised via actuation of the actuators 338, a bucket 374 or other implement attached to the implement interface 370 at the second ends 332B of the lift arms 332 will tend to move in a mostly vertical direction. An example lift path of the bucket 374 as moved by the lift arm structure 330 can be seen in FIGS. 6-8, which illustrate the movement of the various parts of the four-bar linkage (and other components) over part of a lifting operation, including the generally vertical movement of the bucket 374. In particular, the driver link 384 constrains and defines the path of the lift arm 332 as it is raised and lowered. This interaction, along with the interaction between the lift arm 332 and the follower link 382, causes the second end 332B of the lift arm 332 to raise vertically, or nearly vertically, as the lift cylinders 338 are extended. Accordingly, the lift path of the bucket 374 can be substantially more vertical than a lift path provided by a radial path lift arm structure (see, e.g., FIG. 3), due in part to the incorporation of the follower links 382 and the driver links 384. However, the orientation of the bucket 374 (as defined for the purpose of this discussion by an angle relative to horizontal of a bottom surface of the bucket 374) may still change substantially relative to the ground as the lift arm is raised from the substantially horizontal position of a bottom surface of the bucket 374, including to exhibit a substantial angle of departure from horizontal along upper portions of the lift path. In some configurations, a bucket can have an angle of departure of up to approximately 70 degrees when its lift arm is fully or nearly fully raised.

Therefore, it may be useful to adapt the general orientation of a bucket over the course of a lifting operation of a power machine that employs a four-bar vertical lift arm structure such as the one shown in FIG. 5 to minimize the angle of departure from horizontal as the lift arm is raised. In some embodiments, characteristic movements of certain elements of vertical path lift arm structures, can provide a mechanism that, if employed to control the orientation of a bucket, can reduce the angle of departure of the bucket or another relevant implement over the range of movement of the lift arm. For example, the lift arm structure 330 is arranged so that as the lift arm 332 of power machine 300 is raised from its lowered position, at least a part of the follower link 382 first rotates backward (i.e., away from the bucket 374). Once the lift arm is raised beyond an inflection point, the follower link 382 then begins to rotate forward.

Figure 9:
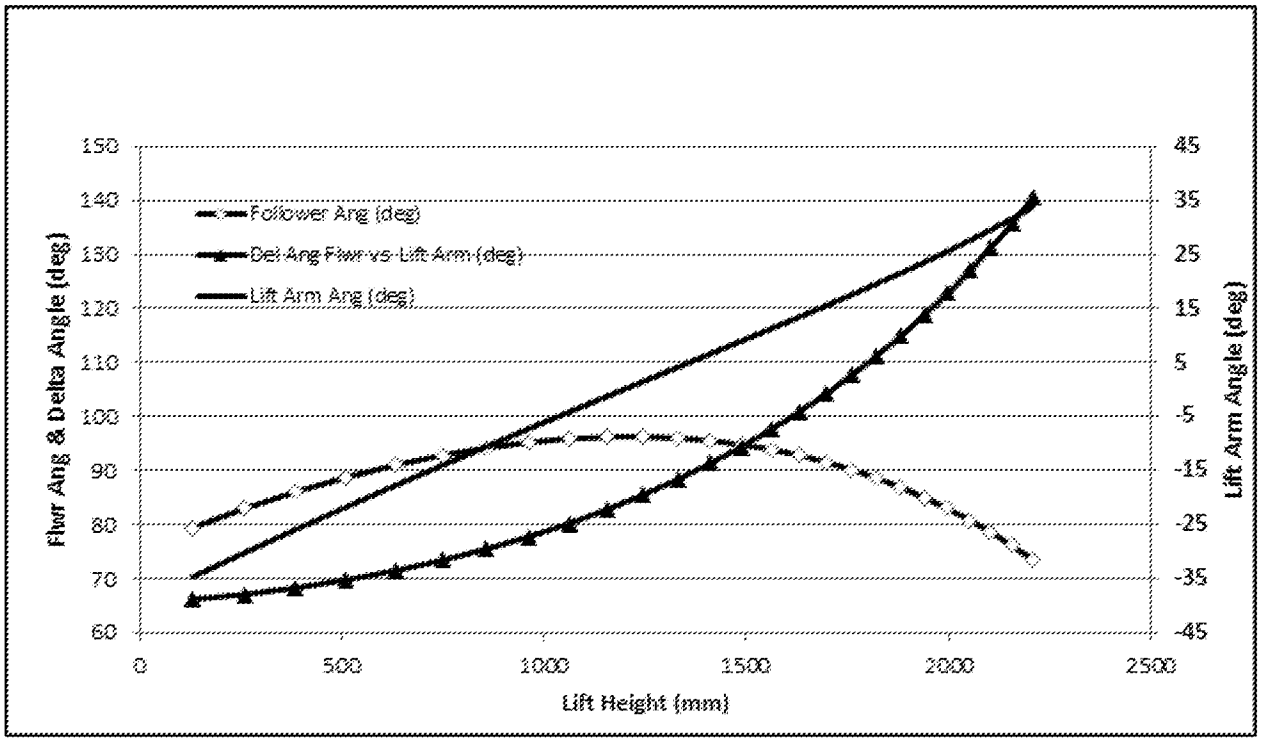
FIG. 9 is a chart depicting certain angles of elements of a lift arm structure of the representative power machine shown in FIGS. 2-3 as the lift arm structure raises a lift arm.

The chart of FIG. 9 illustrates one example of this movement, with data points along lines 392, 394 being representative of the angles of the follower link 382 and the lift arm 332, respectively, with respect to the ground as the lift arm 332 is raised. Further, data points along line 396 are representative of the angle between the follower link 382 and the lift arm 332 as the lift arm 332 is raised. Scale for the lines 392, 396 is provided on the left-side vertical axis, and scale for the line 394 is provided on the right-side vertical axis, both relative to lift height as illustrated on the horizontal axis.

For the illustrated example, the orientation of follower link 382 changes in angle by approximately 18 degrees during the initial backward movement away from the bucket 374, from an originating orientation of about approximately 79.4 degrees relative to the ground, to a maximum of about 96.2 degrees relative to the ground when the bucket 374 has reached about 54% of the maximum lift height. Forward movement of the follower link 382 then begins, as the lift arm 332 continues to be raised, and continues until the bucket 374 has reached the maximum lift height and the follower link 382 is angled at approximately 73.4 degrees to the ground. Correspondingly, it can also be seen that the angle between the follower link 382 and the lift arm 332 increases at first slowly and then more quickly during the lifting of the bucket 274 from the ground to the maximum lift height, from about 66 degrees to about 140.5 degrees. In other embodiments, other ranges or profiles of angular movement and angular differences are possible, depending on the geometry of a given lift arm structure.

The description of power machine 100 and loaders 200, 300 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on loaders such as loaders 200, 300, unless otherwise noted or recited, the concepts discussed below are not intended to be limited in their application to the environments specifically described above.

Figure 10:
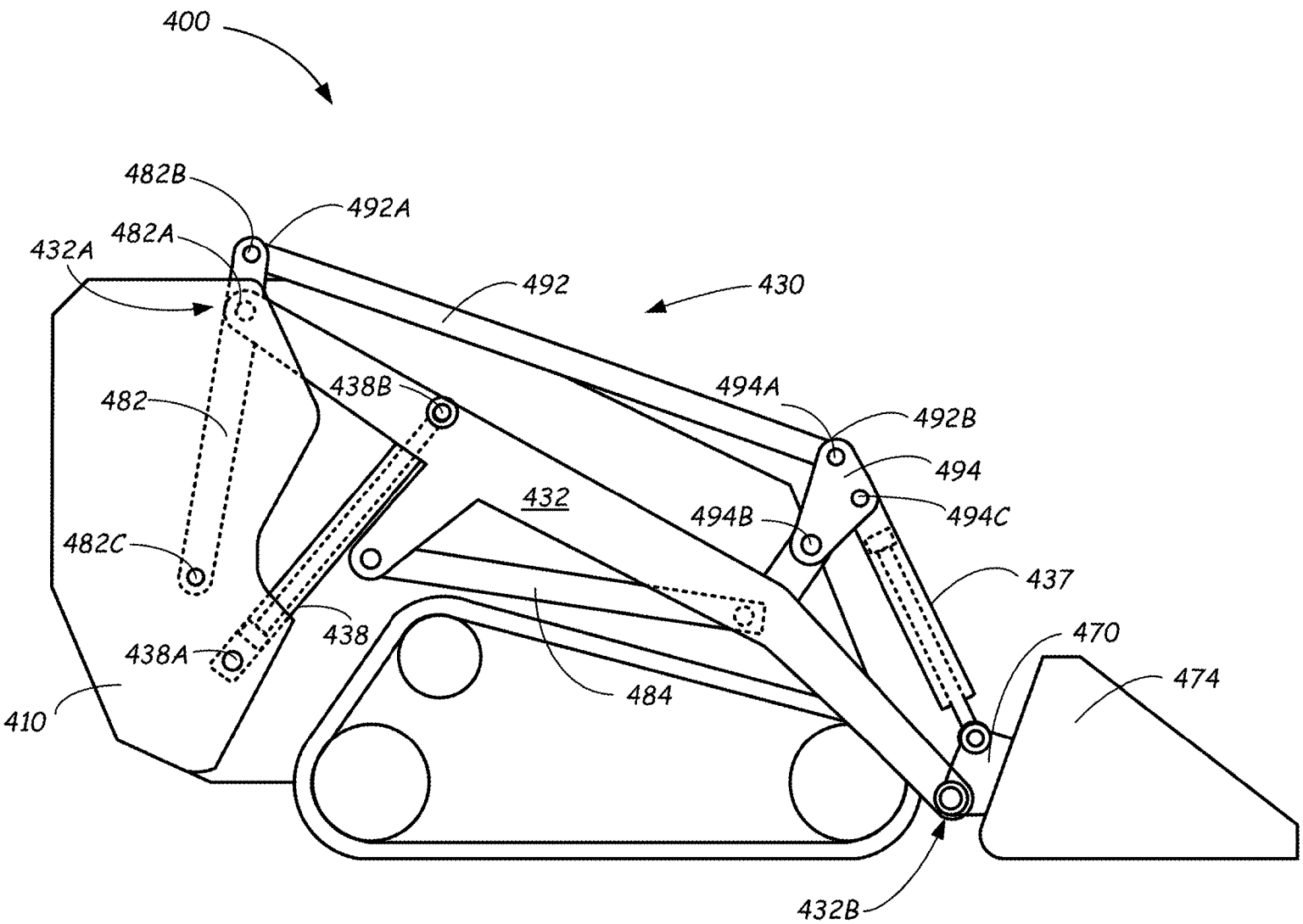
FIGS. 10-12 are schematic side elevation views of a representative power machine, in the form of a skid-steer loader of the type on which the disclosed embodiments can be practiced, during a lifting operation.
Figure 11:
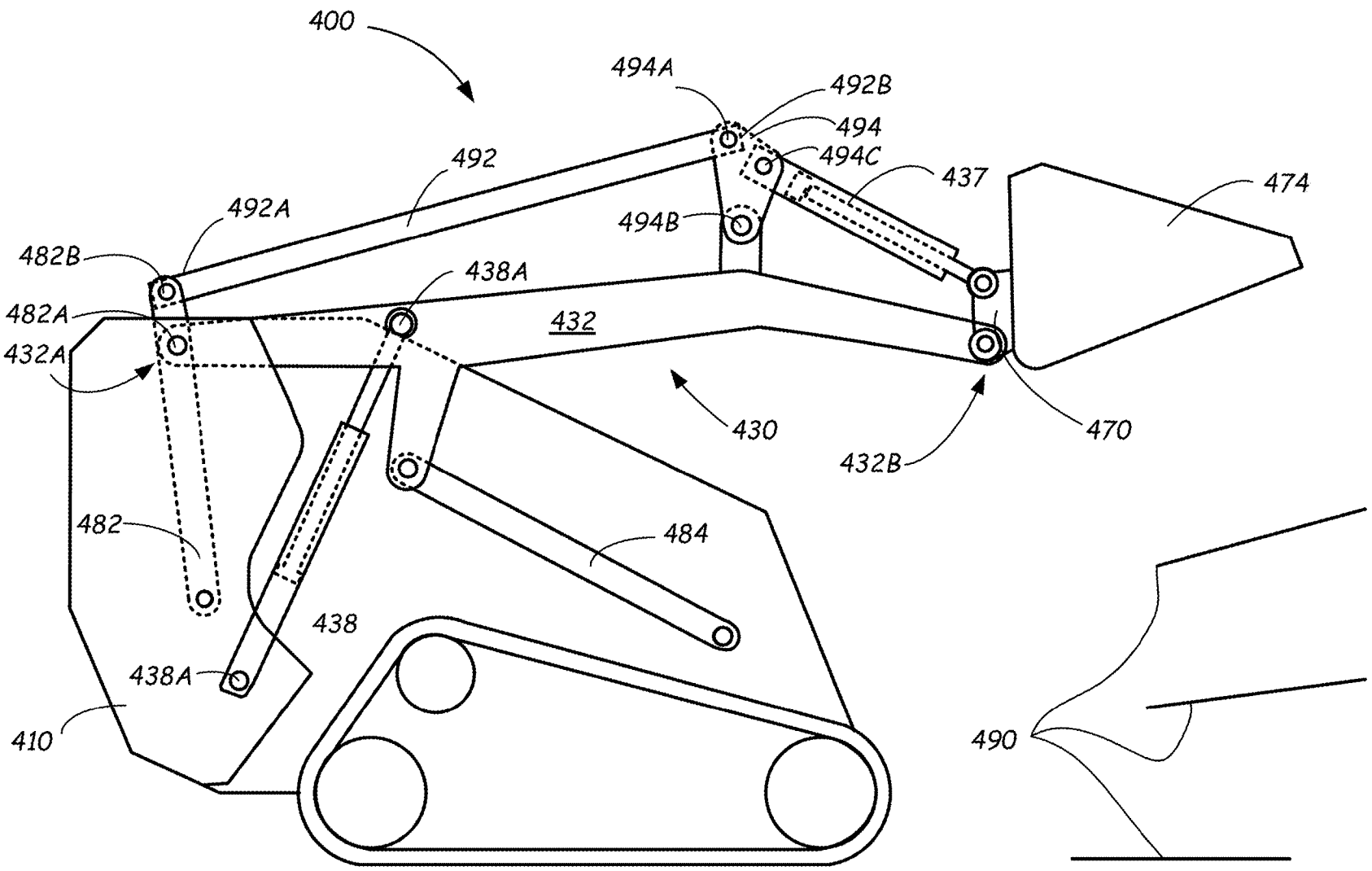
Figure 12:
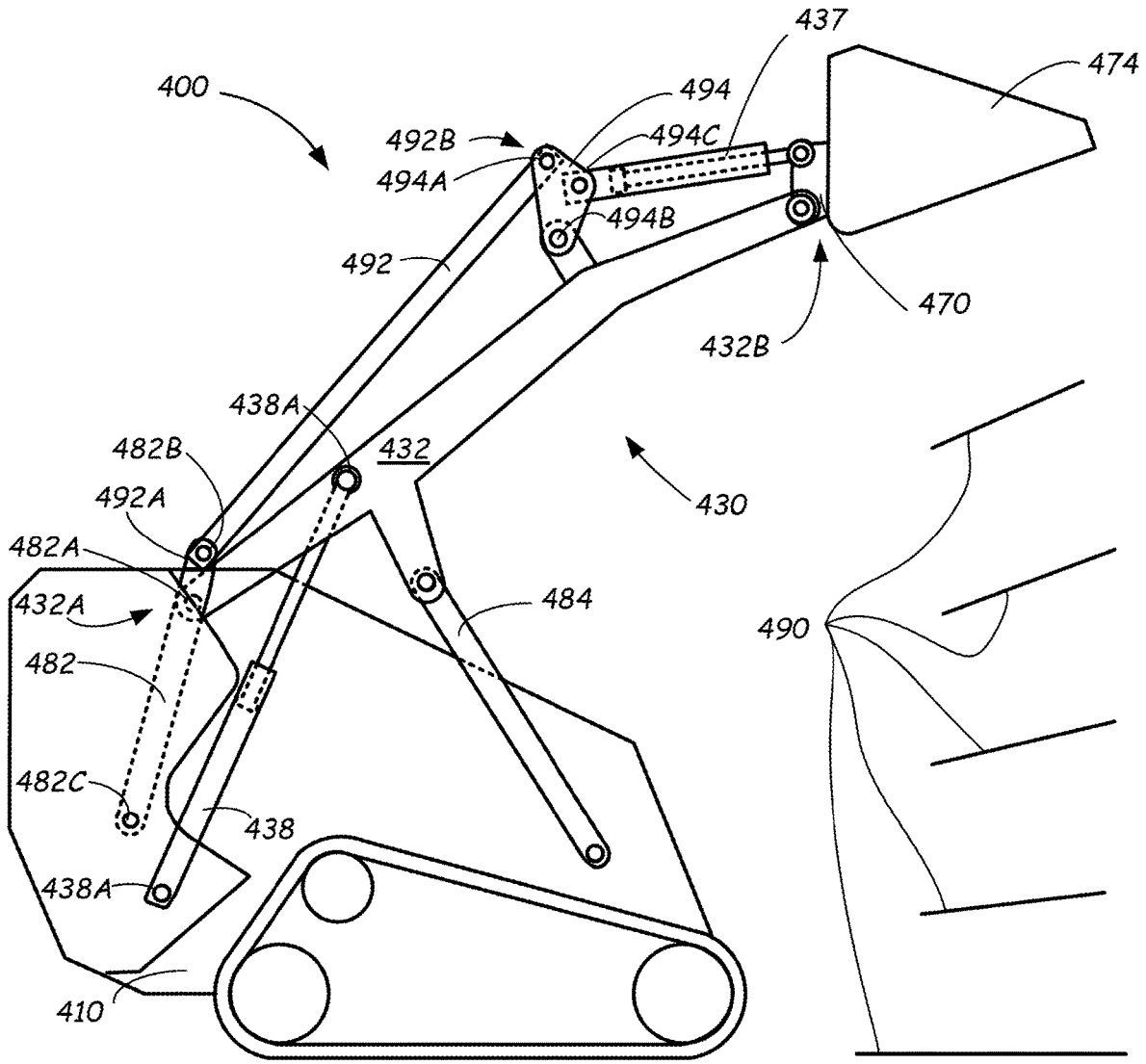

FIGS. 10-12 illustrate geometric relationships of a loader 400 which is another particular example of a power machine of the type illustrated in FIG. 1 where the embodiments discussed below can be advantageously employed. Loader 400 is similar in some ways to the loaders 200, 300 described above, and like numbers represent similar parts. In particular, loader 400 is a mini-loader, like loader 200, with a four-bar vertical lift arm structure, like loader 300. Like the loaders 200 and 300, the loader 400 has a frame 410, at least one lift arm 432 that is pivotally coupled to an implement interface 470 at a forward end of the lift arm 432 and a forward end of the loader 400 (with the lift arm 432 fully lowered), and an implement carrier actuator 437 that is pivotally coupled to the implement interface 470. The loader 400 also has a bucket 474 coupled to the implement interface 470, although differently configured implements are possible.

Like the loaders 200 and 300, the loader 400 has at least one actuator 438 pivotally coupled to both the frame 410 and the lift arm 432 at pivotable joints 438A and 438B respectively. As with the actuators 238, 338 (see FIGS. 3 and 5), the actuator 438 is sometimes referred to individually and collectively as a lift cylinder and can be a hydraulic cylinder configured to selectively receive pressurized fluid from a power system (not shown in FIGS. 10-12); however, other types of actuators are contemplated.

As alluded to above, the loader 400 also incorporates a lift arm structure 430 that is similar in some ways to the lift arm structure 330, with a a follower link 482 (e.g., first link) that is pivotally coupled to the frame 410 and is also pivotally coupled to a first end 432A of the lift arm 432 at a lift arm pivotable joint 482A that is located along the follower link 482 between opposing ends thereof. Further, opposing ends of a driver link 484 (e.g., second link) are pivotally coupled to a rearward location on the lift arm 432 and to the frame 410, respectively. In this regard, for example, the lift arm structure 430, in particular via the lift arm 432, the follower link 482, and the driver link 484, provides a vertical path lift arm structure, with a range of movement of the lift arm 432 that may be generally similarly to the range of movement of the lift arm 332 (see, e.g., FIGS. 6-8).

One way in which the lift arm structure 430 of the loader 400 differs from the lift arm structure 330 of the loader 300 is that the lift arm structure 430 further incorporates at least one leveling link 492 and at least one multi joint member, shown here as a bell crank 494, with a first pivotable joint 494A, a second pivotable joint 494B, and a third pivotable joint 494C. A first end 492A of the leveling link 492 is pivotally coupled to a leveling pivotable joint 482B on the follower link 482, which is spaced apart from (e.g., generally above and not aligned along rotational axes with) the lift arm joint 482A. The lift arm joint 482A is itself spaced apart from a pivotable joint 482C between the frame 410 and the follower link 482, and generally between the pivotable joints 482B 482C along the follower link 482. In various embodiments, the position of joint 482B can be located in any position on the following link 482 such as may be advantageous to the particular geometry of a particular lift arm assembly.

Continuing, a second end 492B of the leveling link 492 is coupled to the first pivotable joint 494A of the bell crank 494 and the second pivotable joint 494B of the bell crank 494 is coupled to the lift arm 432, such that the bell crank 494 secures the leveling link 492 to the lift arm 432 via the two pivotable joints 494A, 494B. Further, the third pivotable joint 494C of the bell crank 494 is pivotally coupled to the bucket 474 via a pivotal coupling of the bell crank 494 to an implement carrier actuator 437, which is itself pivotally coupled to an implement interface 470 that supports the bucket 474. Accordingly, the bell crank 494 also couples the implement carrier actuator 437 to the lift arm 432 via the two pivotable joints 494B, 494C, and couples the leveling link 492 to the implement carrier actuator 437 via the two pivotable joints 494A, 494C, on opposing sides of the intermediary pivotable joint 494B between the bell crank 494 and the lift arm 432.

In other embodiments, a multi joint member, including a bell crank, can be pivotally coupled to an implement in other ways, including via other types of tilt actuators or other bodies (e.g., rigid or articulating links). In some embodiments, a leveling link can extend below or across a lift arm, rather than above a lift arm such as shown for the leveling link 492, to transmit force from a follower link to a multi joint member.

Also in the example shown in FIGS. 10-12, the pivotable coupling between the lift arm 432 and the bell crank 494 (i.e., the pivotable joint 494B) is disposed along the lift arm 432 opposite to the pivotable coupling between the lift arm 432 and the follower link 482 (i.e., the pivotable joint 482A). And pivotable joints between the lift arm 432 and, respectively, the lift actuator 438 and the driver link 484 are supported in sequence along the lift arm 432 between the pivotable joints 482A, 494B. Further, with the bucket 474 fully lowered, the pivotable joint 482C secures the follower link 482 to the frame 410 as a rearmost pivotable joint of the lift arm structure 430, and the pivotable joints on the bell crank 494 (and in particular the pivotable joint 494C to pivotally secure the bell crank 494 to the bucket 474 via the implement carrier actuator 437) are the forward-most pivotable joints of the lift arm structure 430. In some embodiments, the relative arrangement of pivotable joints in the power machine 400 may provide optimal tilt control over a large range of lift arm angles. In other embodiments, however, other configurations are possible.

As illustrated in FIGS. 10-12, the follower link 482 is arranged to first move backwards before it moves forward, as the lift arm 432 is being raised by actuation of the four-bar linkage by the actuator 438. Further, as a result of this initial backward movement, the relative angle between the follower link 482 and lift arm 432 increases slowly at first, as the lift arm is raised, then more rapidly, as similarly illustrated for the loader 300 in FIG. 9.

By incorporating the leveling link 492 and the bell crank 494 between the follower link 482 and the bucket 474, the lift arm structure 430 utilizes the relative movements of the lift arm and the follower link to control the orientation of the bucket 474 in an automated mechanical fashion. For example, as shown in FIGS. 10-12, in the lower part of the lift range of the lift arm structure 430, the bucket 474 rotates backwards somewhat, partly due to the backward movement of the follower link 482, the mechanical connection provided by the leveling link 492, and the corresponding rearward pivoting of the bell crank 494 relative to the pivotable joint 494B between the bell crank 494 and the lift arm 432. This can be useful, for example, so that material in the bucket 474 may tend not to fall forward out of the bucket 474 during initial lifting.

Further, as the lift arm 432 continues to be raised and the follower link 482 begins to move forward, the leveling link 492 pushes and rotates the bell crank 494 forward relative to the pivotable joint 494B (with clockwise rotation from the illustrated perspective) and thereby moves the pivotable joint 494C generally toward the bucket 474. Accordingly, the bell crank 494 urges the implement carrier actuator 447 toward the bucket 474, which urges the bucket 474 to rotate forward and thereby helps to limit backward tilting of the bucket 474 and maintain the bucket 474 in an orientation closer to horizontal during lifting than would otherwise occur. As illustrated by bucket angle lines 490 in FIGS. 11 and 12, for example, the angle of departure of the bucket 474 may change relatively little relative to horizontal over the full lifting range of the loader 400.

Figure 13:
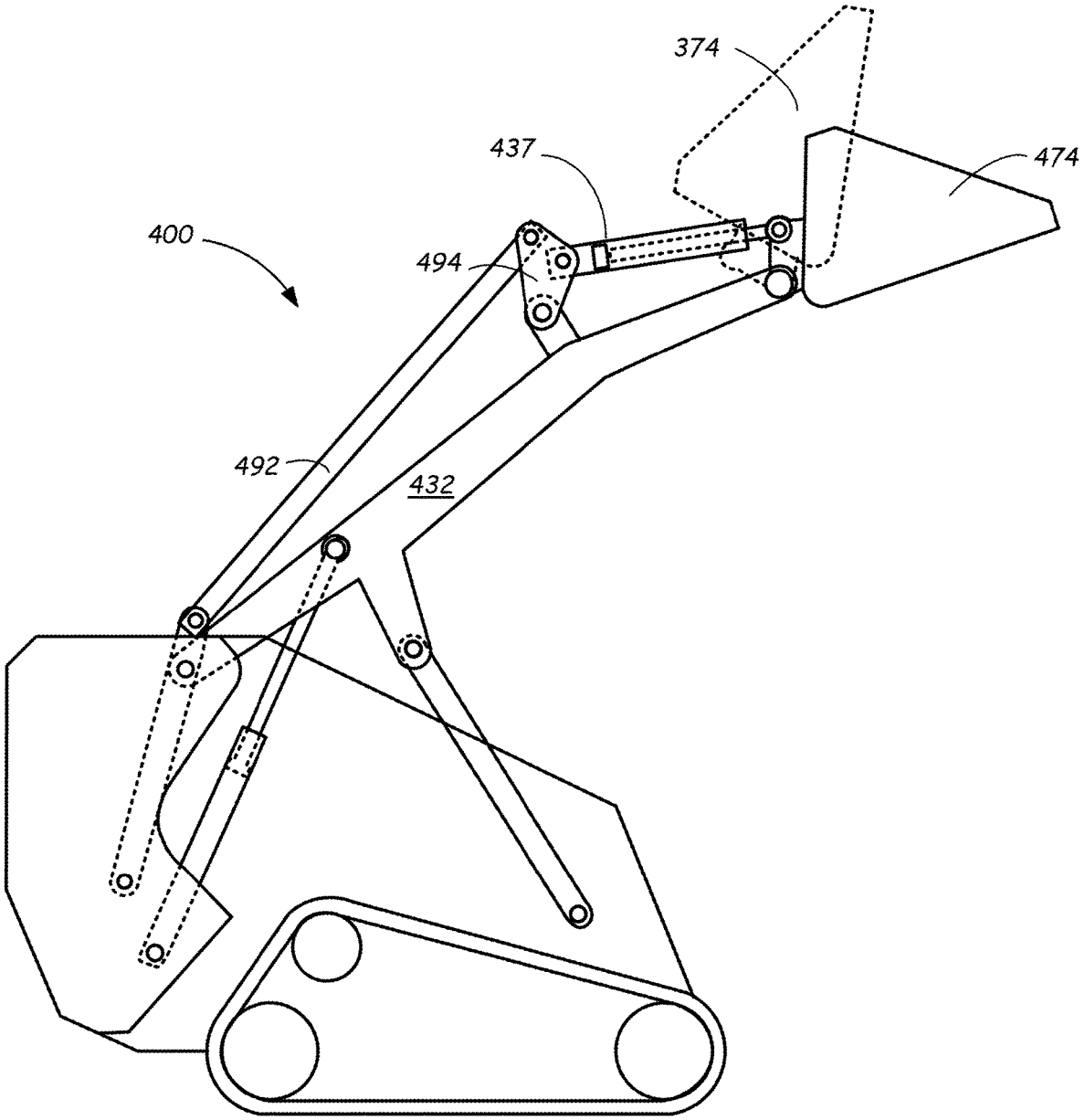
FIGS. 13 and 14 are schematic side elevation views of the power machine shown in FIG. 10 after certain lifting operations, with an overlapping view of an implement of the power machine shown in FIG. 2-3 after similar lifting operations.

In this regard, due to the inclusion of a leveling link, some embodiments may exhibit notable improvement over conventional designs with regard to maintaining a more consistent orientation relative to horizontal control for implements over the course of a lifting operation. For example, FIG. 13 illustrates an overlap of maximum lift height positions of the buckets 374, 474 for each of the loaders 300, 400, respectively, after the buckets 374, 474 have started the lifting operation at a zero-degree rotation relative to the ground. It can be seen that the leveling link 492 and the bell crank 494 (and the lift arm structure 430 generally) substantially promote leveling of the bucket 474 of the loader 400, as compared to the bucket 374 of the loader 300, over similar lift paths of the lift arms 332, 432.

Figure 14:
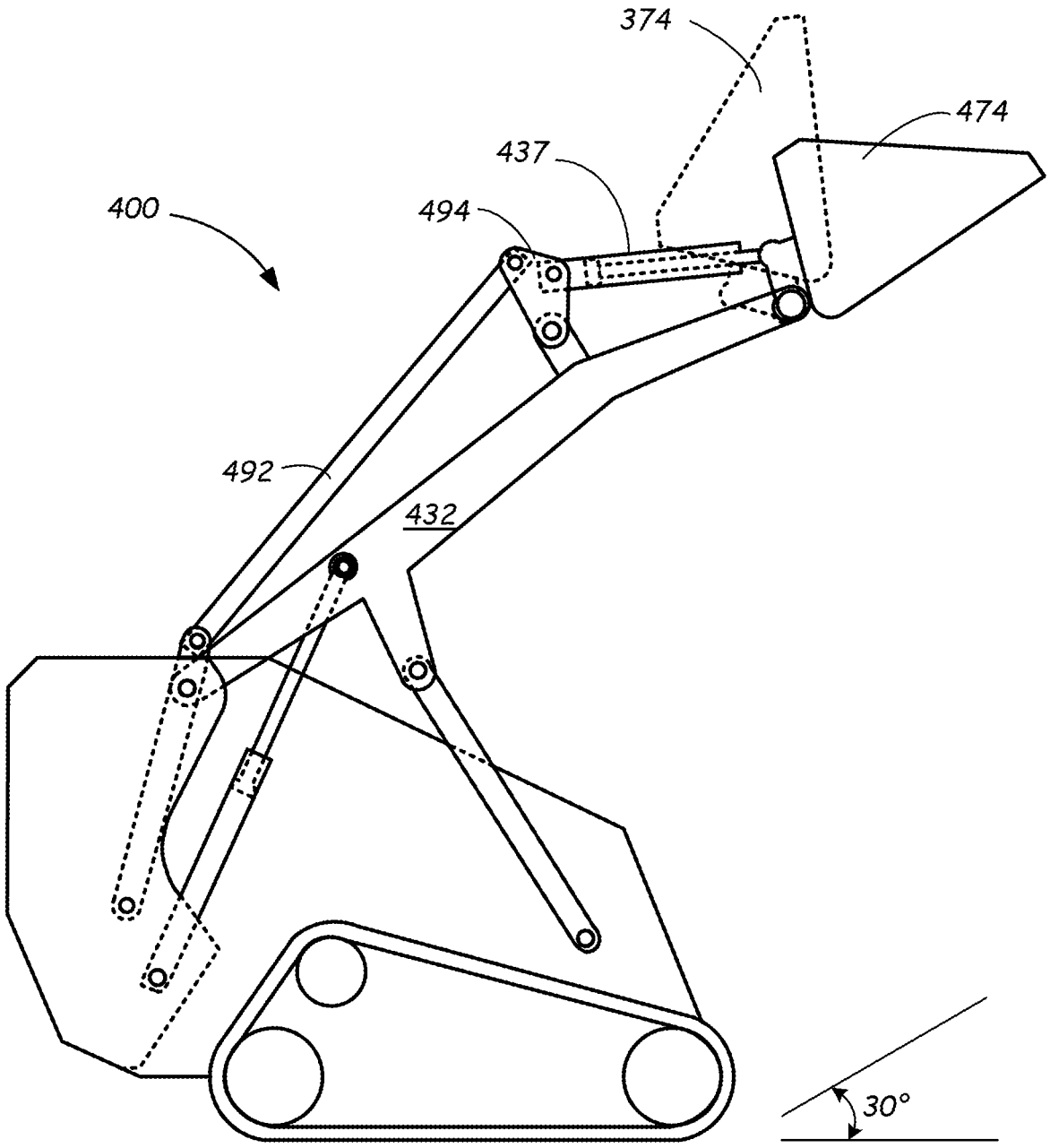

Similarly, FIG. 14 illustrates an overlap of maximum lift height positions of the buckets 374, 474 for each of the loaders 300, 400, respectively, after the buckets 374, 474 have started the lifting operation at a 30-degree backwards rotation relative to horizontal. Once again, the leveling link 492 and the bell crank 494 substantially promote an orientation of the bucket 474 of the loader 400 as compared to the bucket 374 of the loader 300 over similar lift paths of the lift arms 332, 432 even when a starting orientation departs from horizontal.

Although not shown in FIGS. 13 and 14, similar benefits can also be obtained for other starting angles of implements relative to horizontal. Similarly, in some embodiments, a linkage arrangement of a lift arm structure can be configured to limit tilting of an implement by other amounts (e.g., more or less than shown for the bucket 474) for a particular elevation or angle of the lift arm. For example, a leveling link, follower link, or other linkage member can be differently sized or oriented than shown, or pivotable joints on one or more linkage members can be different located than shown, relative to each other or to other reference points on a power machine.

Correspondingly, in other embodiments, other configurations and geometric arrangements of the various links of a lift arm assembly are possible and a leveling (or other) link can be adapted provide similar advantages as discussed above with differing geometries. For example, the follower link 482 shown in FIGS. 10-12 is a linear link, but a non-linear (e.g., curved or angularly bent) follower link can be used in some embodiments, such as may be appropriate for certain overall configurations of a lift arm structure. Similarly, other links shown as linear or non-linear in the FIGs. may in some cases be configured differently. In some embodiments, a follower link or a leveling link can be longer or shorter than is illustrated for the follower link 482 or the leveling link 492. Moreover, a joint between a leveling link and a follower link (e.g., the pivotable leveling joint 482B in FIG. 12) can be differently configured, such by being differently located relative to a joint between the follower link and a lift arm (e.g., the joint 482A in FIG. 12) or relative to other components. For example, a joint between leveling and follower links can be disposed at a location that is different than the lift arm joint 482A (e.g., as shown in FIGS. 10-12 or at other locations along the follower link 482) or can be disposed at a location that overlaps with a joint between the lift arm and the follower link. Similarly, some embodiments may exhibit other relative orientations of particular components, such as in the relative forward, rearward, or other orientation of particular joints relative to others.

In some embodiments, a different multi-bar linkage can be used, such as a four-bar linkage with a different arrangement for a lift arm, a follower link, and a driver link relative to a frame than the arrangement illustrated in the FIGs. or a linkage with a different number of links. In some embodiments, a different multi joint member (e.g., a linkage member with three or more joints) can be used to pivotally couple together a leveling link, a lift arm, and an implement carrier actuator, or other components. For example, some multi joint members may include one or more arms that extend from a common location to support associated joints.

As another example, some multi joint members can be formed as multiple rigidly connected pieces that respectively support separate pivotable joints. Some multi-joint members can be formed as plates or other integral (i.e., single-piece) bodies that support each of the associated pivotable joints, alone or in combination with other components. In some embodiments, a single-piece multi joint member can be formed as a rigid single-piece bell crank, or as a plate or other body with holes to receive pivot pins. In some embodiments, a single-piece multi joint member can be used in combination with another single-piece multi-joint member to cooperatively support a set of multiple pivotable joints. For example, two similar multi joint members can be disposed on an opposite side of a set of pivot pins to rotatably support a common set of links.

The embodiments above provide several advantages. For example, a lift arm structure according to some embodiments can help to substantially reduce the amount of backward tilt of an implement being lifted thereby. This can help to reduce (e.g., eliminate) the need to have other types of leveling devices or mechanisms, such as may require additional operations or care by an operator or the diversion of hydraulic fluid away from a lift arm actuator. Further, in some embodiments, leveling links can be implemented with regard to conventional lift arm structures with relatively little modification thereof.

In some embodiments, lift arm structures disclosed herein, including the lift arm structure 430 of FIGS. 10-12, can help to reduce the tilting movement of an implement during a lifting operation without requiring other actuators to concurrently tilt the implement (other than the inherent tilting effect introduced onto an implement by operation of a lifting actuator, such as the actuator 438, to raise or lower a lift arm). For example, some lift arm structures, including the lift arm structure 430, can reduce tilting of an implement during lifting operations without using or requiring the active or passive operation of an actuator that extends between the lift arm structure and an implement, including actuators such as the implement carrier actuator 437. However, in some embodiments, additional tilt control can be implemented, including tilt control effected through active or passive operation of hydraulic or other actuators (e.g., the implement carrier actuator 437 of FIGS. 10-120) to tilt of an implement that is supported by a lift arm structure as disclosed herein.

Although the subject matter has been described in language specific to structural features and/or methodological acts, it is to be understood that the subject matter defined in the appended claims is not necessarily limited to the specific features or acts described above.

What is claimed is:

1. A mini-loader comprising:

a frame;

an operator station positioned toward the rear of the frame and configured to be used by an operator who is behind or on the rear of the frame;

a lift actuator movable between a retracted position and an extended position; and a lift arm structure movable by the lift actuator relative to the frame, the lift arm structure including a multi-bar linkage configured to raise and lower an implement supported by the lift arm structure as the lift actuator moves between the retracted and extended positions, the multi-bar linkage including:

a follower link pivotally secured to the frame;

a lift arm pivotally secured to the follower link at a first pivotable joint and pivotally secured to the lift actuator; and a driver link pivotally secured to the lift arm and to the frame;

a multi-joint member pivotally secured to the implement via an implement carrier actuator that is controllable to tilt the implement relative to the lift arm and pivotally secured to the lift arm; and a leveling link pivotally secured to the follower link at a second pivotable joint that is spaced apart from the first pivotable joint, and pivotally secured to the multi-joint member, to transmit force from the follower link to the implement via the multi-joint member as the lift actuator moves between the retracted position and the extended position;

wherein the follower link is secured to the frame at a third pivotable joint; and wherein the second pivotable joint is positioned at an opposite end of the follower link from the third pivotable joint and the first pivotable joint is positioned between the second and third pivotable joints along the follower link.

2. The mini-loader of claim 1, wherein, as the lift actuator moves from the retracted position toward the extended position, the follower link is arranged to pivot in a first direction relative to the frame and subsequently to pivot in a second direction relative to the frame to move the leveling link toward the multi joint member.

3. The mini-loader of claim 1, wherein the driver link is pivotally secured to frame separately from the follower link.

4. The mini-loader of claim 1, wherein the multi joint member is configured to pivot forwards relative to the lift arm as the leveling link moves toward the multi joint member to limit backward tilting of the implement.

5. The mini-loader of claim 1, wherein the second pivotable joint is positioned above the first pivotable joint.

6. The mini-loader of claim 1, wherein the second pivotable joint is positioned below the first pivotable joint.

7. The mini-loader of claim 1, wherein, as the lift actuator moves from the retracted position toward the extended position, the follower link is arranged to pivot in a first direction relative to the frame and subsequently to pivot in a second direction relative to the frame to move the leveling link away from the multi joint member.

8. The mini-loader of claim 1, wherein the multi joint member is a single-piece multi joint member.

9. The mini-loader of claim 8, wherein the single-piece multi joint member is a bell crank.

10. A lift arm structure for a power machine with a frame, for use with an implement and an implement actuator that is configured to tilt the implement, the lift arm structure comprising:

a vertical path lift arm structure that includes:

a first link and a second link, each of which is separately pivotally secured to the frame and to a lift arm;

a leveling link pivotally secured to the first link, wherein, along the first link, the pivotable joint that secures the first link to the lift arm is between a pivotable joint that secures the first link to the leveling link and a pivotable joint that secures the first link to the frame; and a multi joint member pivotally secured to the leveling link, the lift arm, and the implement actuator, to mechanically transmit tilting force from the leveling link to the implement, via the implement actuator, as the lift arm structure is actuated to raise or lower the implement.

11. The lift arm structure of claim 10, wherein, along the lift arm, a pivotable joint that secures the second link to the lift arm is between a pivotable joint that secures the first link to the lift arm and a pivotable joint that secures the multi joint member to the lift arm.

12. The lift arm structure of claim 11, wherein the pivotable joint that secures the first link to the leveling link is above the pivotable joint that secures the first link to the frame, relative to the power machine.

13. The lift arm structure of claim 10, wherein, with the lift arm in a fully lowered position relative to the power machine, the pivotable joint that secures the multi-joint member to the lift arm is forward of pivotable joints that secure the first link and the second link to the lift arm, from the perspective of the power machine.

14. The lift arm structure of claim 13, wherein, with the lift arm in the fully lowered position relative to the power machine, the pivotable joint that secures the multi-joint member to the lift arm is configured to be forward of pivotable joints that secure the first and second links to the frame, from the perspective of the power machine.

15. A lift arm structure for a power machine with a frame, for use with an implement carrier, the lift arm structure comprising:

a multi-bar linkage pivotally secured to the frame, the multi-bar linkage including:

a lift arm, a driver link pivotally secured to the lift arm and to the frame, and a follower link with a leveling joint, the follower link being pivotally secured to the lift arm at a follower-lift-arm pivotable joint spaced apart from the leveling joint, and pivotally secured to the frame at a follower-frame pivotable joint opposite the follower-lift-arm pivotable joint, the leveling joint being positioned between the follower-frame and follower-lift-arm pivotable joints along the follower link; and a leveling link pivotally secured to the follower link at the leveling joint, and pivotally secured to the implement carrier and to the lift arm via at least three pivotable joints on a multi-joint member, to mechanically transmit force from the follower link to the implement carrier and there by urge the implement carrier to pivot relative to the lift arm as the multi-bar linkage is actuated to raise or lower the implement carrier.

16. The lift arm structure of claim 15, for use with an implement carrier actuator configured to tilt the implement carrier, wherein the leveling link is pivotally secured to the implement carrier via the implement carrier actuator; and wherein the leveling link is pivotally secured to the implement carrier actuator via the multi joint member.

17. The lift arm structure of claim 15, wherein the leveling link is configured to pivot in a direction away from the implement carrier before pivoting in a direction toward the implement carrier as the multi-bar linkage is actuated to raise the lift arm; and wherein the leveling link is configured to rotate the multi-joint member relative to the lift arm, in the direction toward the implement carrier, as the leveling link pivots in the direction toward the implement carrier.

* * * * *